US005615526A

United States Patent [19]

Palmer et al.

[11] Patent Number: 5,615,526

[45] Date of Patent: Apr. 1, 1997

[54] DRAINS FOR SINGLE LAYER SYNTHETIC ROOFING AND WATERPROOFING MEMBRANES

[76] Inventors: Dale W. Palmer, 22806 66th Ave. W., Mountlake Terrace, Wash. 98043; John F. Pittman, 10721 Meridian Ave., Ste. 1413, Seattle, Wash. 98133-9020

[21] Appl. No.: 436,139

[22] Filed: May 8, 1995

[51] Int. Cl.[6] ..... E04D 13/14

[52] U.S. Cl. ..... 52/302.1; 52/302.6; 52/198; 52/1; 210/163; 210/166

[58] Field of Search ..... 52/11, 12, 302.1, 52/302.6, 198; 210/162, 163, 166

[56] References Cited

U.S. PATENT DOCUMENTS

| | | | |
|---|---|---|---|
| 1,991,772 | 2/1935 | Rieger et al. | 210/166 |
| 2,091,927 | 8/1937 | Hirshstein | 210/166 X |
| 2,121,220 | 6/1938 | Filkins | 210/166 |
| 2,142,343 | 1/1939 | Boosey | 210/166 |
| 2,256,626 | 9/1941 | Rile | 210/166 |
| 2,284,416 | 5/1942 | Gordon | 210/166 |
| 2,619,920 | 12/1952 | Lindquist . | |
| 2,666,493 | 1/1954 | Gordon | 210/166 |
| 3,357,561 | 12/1967 | Schmid et al. . | |
| 4,112,632 | 9/1978 | Simpson . | |
| 4,122,230 | 10/1978 | Lowell . | |
| 4,652,365 | 3/1987 | Ebeling . | |
| 5,144,782 | 9/1992 | Paquette et al. . | |
| 5,234,582 | 8/1993 | Savoie . | |
| 5,469,670 | 11/1995 | Thaler | 52/12 |

FOREIGN PATENT DOCUMENTS

| | | | |
|---|---|---|---|
| 0137569 | 4/1947 | Australia | 210/163 |
| 9405876 | 3/1994 | WIPO | 52/302.1 |

*Primary Examiner*—Wynn E. Wood
*Attorney, Agent, or Firm*—Charlene A. Launer

[57] ABSTRACT

An inexpensive drain assembly for draining water from flat roofs, balconies, decks and other flat or low sloping surfaces that are covered with a water-tight single layer synthetic roofing and waterproofing membrane. The drain assembly includes a grate having a strainer and a connecting collar, a flanged boot that is contoured to fit snugly around the collar of the grate and is sealed via the flange to the synthetic membrane, and a pipe connector that connects the grate and contoured boot to a standard drain pipe. The flanged boot is made from elastomer that is identical to or compatible with and sealably attachable to the synthetic membrane. The elastomer and the synthetic membrane are made of materials selected from a group consisting of synthetic rubber, rubber-like materials, plastic, and plastic-like materials.

18 Claims, 6 Drawing Sheets

DRAINS FOR SINGLE LAYER SYNTHETIC ROOFING AND WATERPROOFING MEMBRANES

BACKGROUND OF THE INVENTION

This invention relates to the draining of water from flat roofs, balconies, decks and other flat or low sloping surfaces that are covered with a water-tight single layer synthetic roofing and waterproofing membrane.

The term "flat or low sloping surfaces" is not limited to surfaces that are perfectly flat. Very few roofs and other surfaces are perfectly flat due to intentional pitch, variations in thickness of construction materials, or sagging over time. Some roofs are deliberately pitched toward the drains so that the water is directed toward the drains. Some architects and roofing contractors rely on evaporation to take care of water that accumulates in low areas. All these roofs visually appear to be flat and are included within the term "flat surfaces". Similarly, decks and balconies rarely are perfectly flat although they visually appear flat. They are not flat for the same reasons flat roofs are not perfectly flat. Hence, the terms "flat" or "low sloping" is used in reference to a roof, balcony or deck with a pitch from 1/16 to two inches per foot.

Many commercial and residential buildings have flat roofs. Until recently, these buildings were weather protected with conventional asphaltic built-up felt membranes or modifications of such systems. Roof drains for these buildings are predominantly made of cast and malleable iron or steel materials. The drains usually consist of a drain bowl, deck and clamping rings, and a strainer cap. When the drain is installed, nails, screws or other mechanical fasteners are used to connect the drain parts to the roof. In addition, sheet metal or lead flashing is used to make a seal around the drain with multiple layers of asphalt felt placed under and over the outer perimeter of the sheet metal or lead flashing and coated with liquid asphalt.

In recent years, single layer sheets of synthetic rubber- , vinyl-, polyethylene- or polypropylene-based materials have become popular alternatives to built-up asphalt roofing. Roofs drains, however, have largely remained unchanged. Many of the drains still consists of cast and malleable iron or steel materials that are nailed, screwed or otherwise mechanically connected to the roof and sealed with sheet metal or lead flashing, asphalt sealing materials and clamping devices. Others consist of sheet metal pans laminated with synthetic rubber, vinyl or polyethylene or polypropylene membranes, and conventional cast iron drain assemblies comprised of a strainer cap, clamping rings or flanges and a drain pipe. An example of this latter technology is shown in U.S. Pat. No. 4,112,632.

More recently, drain devices made of synthetic rubber, vinyl, polyethylene or polypropylene have become available. These drain devices require extensive field assembly using mechanical clamping devices that attach and seal the drain to the roof by penetrating the synthetic membrane roofing material with screws, nails or other fasteners and, in some instances, laminated metal flashing materials.

SUMMARY OF THE INVENTION

It is an object of the invention to provide a drain assembly specifically designed for single layer synthetic roofing or waterproofing membranes covering flat or low sloping surfaces that is supplied as a completely assembled unit, including a completed seal at the drain.

Another object of the invention is to provide an inexpensive drain assembly that will fit plumbing industry standard 2-, 3-, 4- and 6-inch pipe sizes without molding custom parts or extensive field assembly using mechanical clamping devices, compression devices or membrane penetrating mechanical fasteners.

A third object of the invention is to provide an inexpensive drain assembly that is compatible with and seals to the single layer synthetic membrane by thermal fusing or other methods used for joining sheets of the synthetic membrane during installation of the single layer synthetic membrane.

According to the present invention, one embodiment of an improved drain for use with synthetic roofing or waterproofing membranes on flat or low sloping surfaces includes (a) a grate having a strainer and a connecting collar, (b) a flanged boot that is contoured to fit snugly around the collar of the grate and is sealed via the flange to the synthetic membrane, and (c) a pipe connector that connects the grate and contoured boot to a standard drain pipe. A second embodiment includes (a) a removable grate having a strainer and a connecting collar, (b) a hub with a longitudinal passageway, a connection inlet for receiving the removable grate at one end of the longitudinal passageway, and a connection outlet at the other end of the longitudinal passageway, (c) a flanged boot that is contoured to fit snugly around the connector outlet end of the hub and is sealed to the synthetic roof membran, and (d) a pipe connector that connects the grate and contoured boot to a standard drain pipe. A third embodiment is adapted for use as an emergency overflow drain structure by lengthing one or more of the component parts. A fourth embodiment is adapted for connecting to a drain pipe housed in or entering the roof area through a wall instead of the roof deck.

BRIEF DESCRIPTION OF THE DRAWINGS

The features of this invention which are believed to be novel are set forth with particularity in the appended claims. The invention itself, however, together with its object and advantages thereof, will be best understood by reference to the following description taken in connection with the accompanying drawings, in which:

DESCRIPTION OF THE PREFERRED EMBODIMENT

Figure 1:
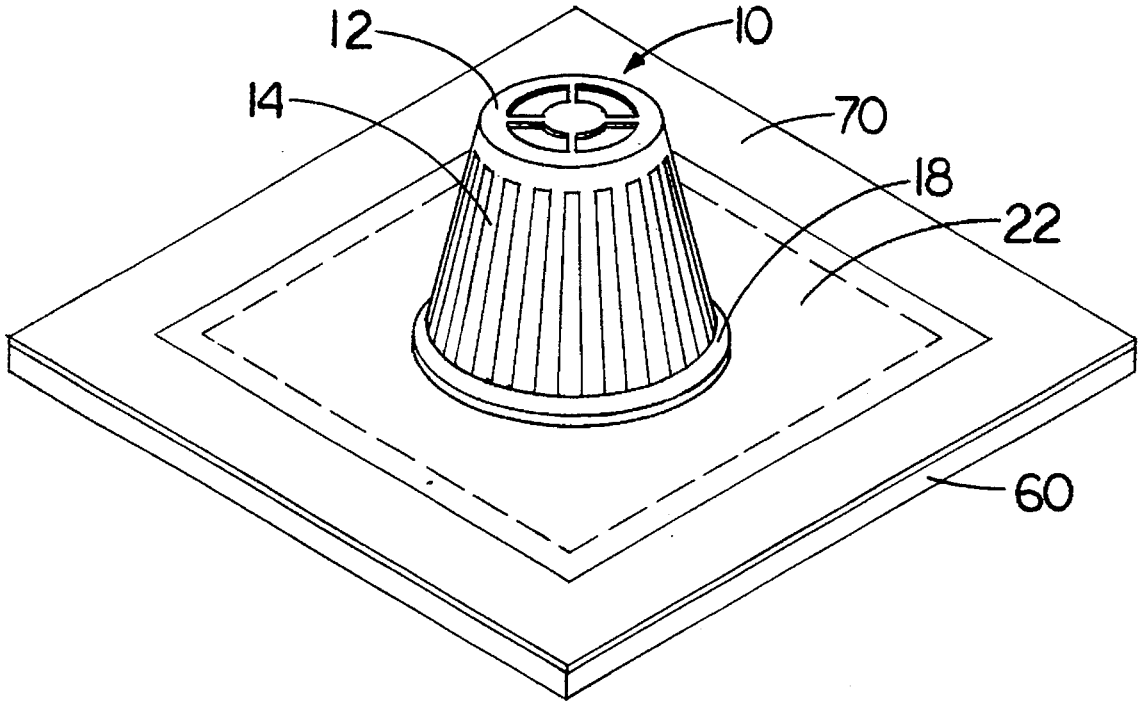
FIG. 1 is a schematic perspective view of a drain in accordance with the present invention.
Figure 2:
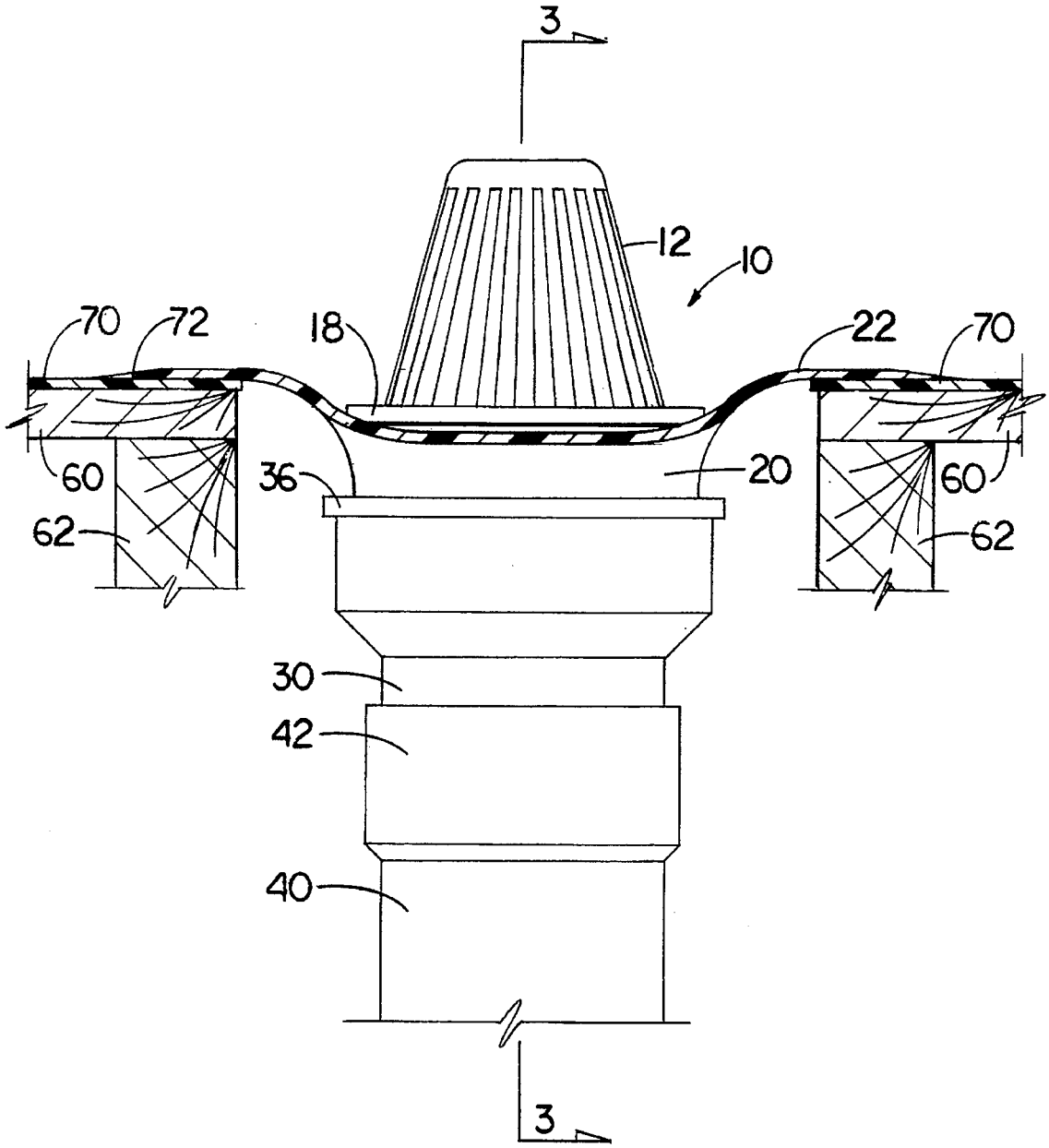
FIG. 2 is an elevational view of the drain of FIG. 1 with part of the roof deck removed to show greater detail.
Figure 3:
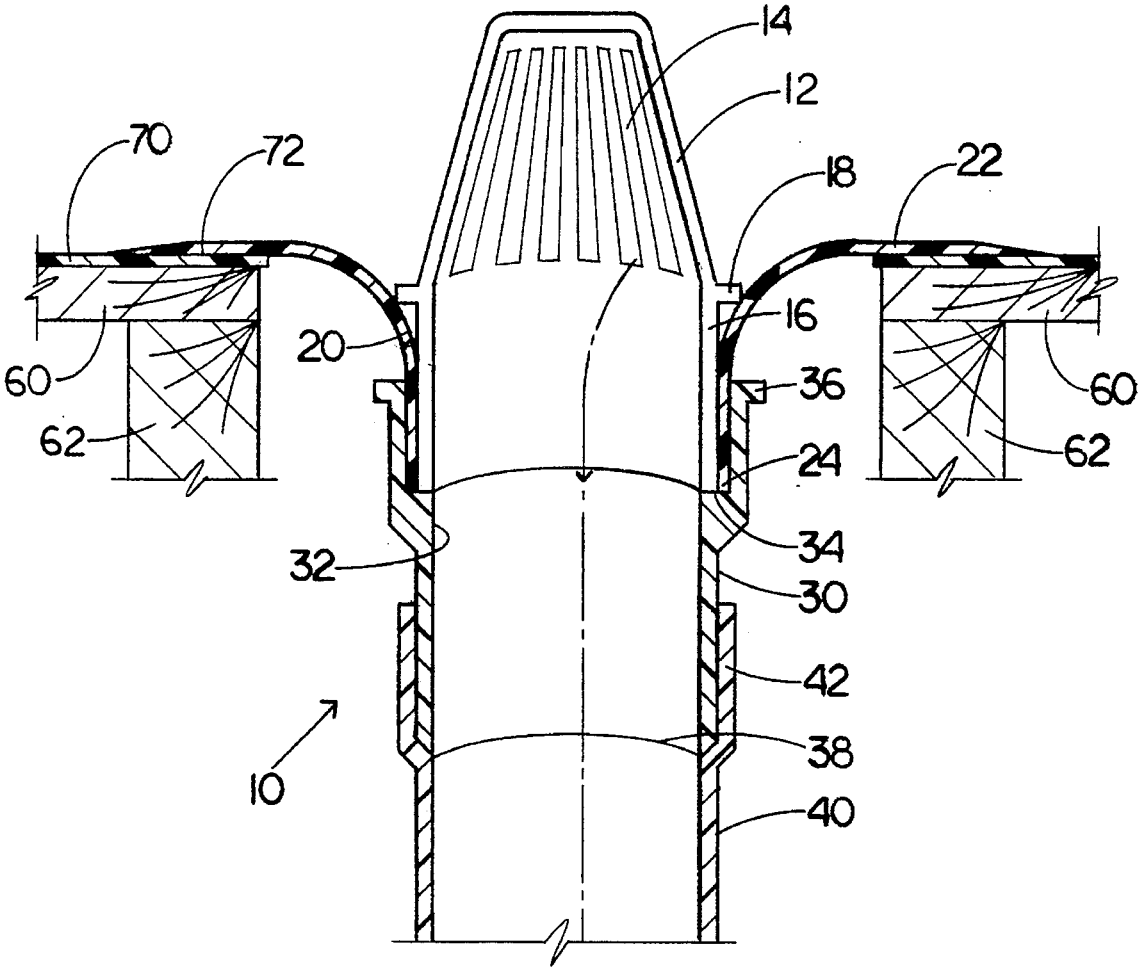
FIG. 3 is longitudinal cross section through the drain taken along line 3—3 of FIG. 2.

Referring to FIGS. 1, 2 and 3, the drain in accordance with one embodiment of the present invention is indicated generally by the reference numeral 10. The drain 10 consists of a one piece grate 12, a contoured boot 20 and a one piece pipe connector 30. The drain is constructed to fit a standard drain pipe 40 having a standard 2-, 3-, 4- or 6-inch diameter.

The one piece grate 12 includes a strainer 14 to prevent debris from entering the drain 10. The strainer 12 may be flat (not shown) so that the top of the drain 10 is lower than or flush with the membrane 70 covering the roof deck 60. More preferably, to increase surface area the strainer 14 is rectangle-, dome- or frustrum-shaped and extends two to four inches above the synthetic membrane 70 covering the roof deck 60.

The grate 12 also includes a collar 16 that nests snugly into the contoured boot 20. Preferably, the grate 12 includes a 4½ to 5 inch exterior grate flange 18 adjacent to the intersection of the strainer 14 and grate collar 16 areas of grate 12. The grate 12 is made of polyvinyl chloride ("PVC"), acrylonitrile butadiene styrene ("ABS"), or high density polyethylene.

The contoured boot 20 is formed from a single piece of an elastomer that is identical to or compatible with the synthetic membrane 70 covering the roof deck 60. The elastomer and synthetic membrane 70 are selected from synthetic rubber, rubber-like materials (e.g., styrene-butadiene rubbers, polybutadiene, polyisobutylene and cholorbutyl, ethylene/propylene, synthetic polyisoprene, nitrile, neoprene, and polyacrylate), plastic, or plastic-like materials (e.g., polyvinyl chlorides, chlorinated polyethylenes, co-polymer alloys consisting of two base polymers, chorosulphanated polyethylene, and tri-polymer alloys consisting of three base polymers). The elastomer may be either thermoset materials (i.e., permanently hardened or solidified by vulcanizing or curing) or thermoplastic (i.e., can be altered or changed by virtue of heat).

The boot 20 is a contoured tube with a flange 22 around the circumference of the boot at one end of the tube and an outlet port 24 at the other end. The boot 20 is contoured to fit snugly around the grate collar 16. The boot 20 may be contoured by any chemical, physical, or mechanical method deemed appropriate. For example, the boot 20 may be contoured by vacuum molding or, in the case of thermoplastic materials, softened with heat, stretched and shaped around grate collar 16 by hand and cut to form the outlet port 24.

The boot flange 22 extends a minimum of one inch beyond the outermost edge of the grate flange 18 of the grate 12 when the grate collar 16 is nested snugly into the contoured boot 20. As described below, boot flange 22 is overlapped onto and sealed to the synthetic membrane 70 covering the roof deck 60. Positive contact between boot flange 22 and grate flange 18 minimizes the amount of water ponding between the boot 20 and grate collar 16.

The one piece pipe connector 30 is made of PVC, ABS or similar materials approved for plumbing. It has a longitudinal passageway 32 ending in an outlet port 38. Preferably the longitudinal passageway 32 has at least one variation in the bore's diameter forming a stop 34. Also the pipe connector 30 preferably has an external flange 36 is located at the end opposite the outlet port 38. The pipe connector 30 is preferably between 3 and 4 inches in length with the stop 34 located at a point about one-third to one-half the length of the longitudinal passageway 32.

To assemble the drain 10, the contoured boot 20 is fitted over the grate collar 16. The nested grate 12 and boot 20 are press fitted into the longitudinal passageway 32 of the pipe connector 30 so that grate collar 16 and boot outlet port 24 abut stop 34 as shown in FIG. 3. Alternatively, the nested grate collar 16 and boot 20 may be press fitted into the longitudinal passageway 32 and permanently sealed to the longitudinal passageway via adhesives or sealants compatible with the pipe connector 30 and the elastomer used to form the boot 30. Press-fitting the nested grate collar 16 and boot 20 against the pipe connector stop 34 or permanently sealing the nested grate collar and boot to the longitudinal passageway 32 prevents any back flow of water between the grate collar 16, boot 20 and the longitudinal passageway 32.

The assembled drain 10 is easily transported to the construction site, inserted through an opening in the roof deck 60 and deck framing 62. The connector outlet port 38 is press-fitted into the receiving end 42 of a plumbing industry standard drain pipe 40. To complete the installation, the perimeter of the boot flange 22 is overlapped onto to the single layer synthetic membrane 70 and a seal 72 formed between the boot flange 22 and the membrane 70. The seal 72 may be formed by heat welding or other methods used for joining sheets of the synthetic membrane during installation of the single layer synthetic membrane 70. The seal 72 must be formed along the entire perimeter of the boot flange 22. The width of the seal 72 will be determined by the method of sealing but in no case less than one inch wide regardless of sealing method.

Figure 4:
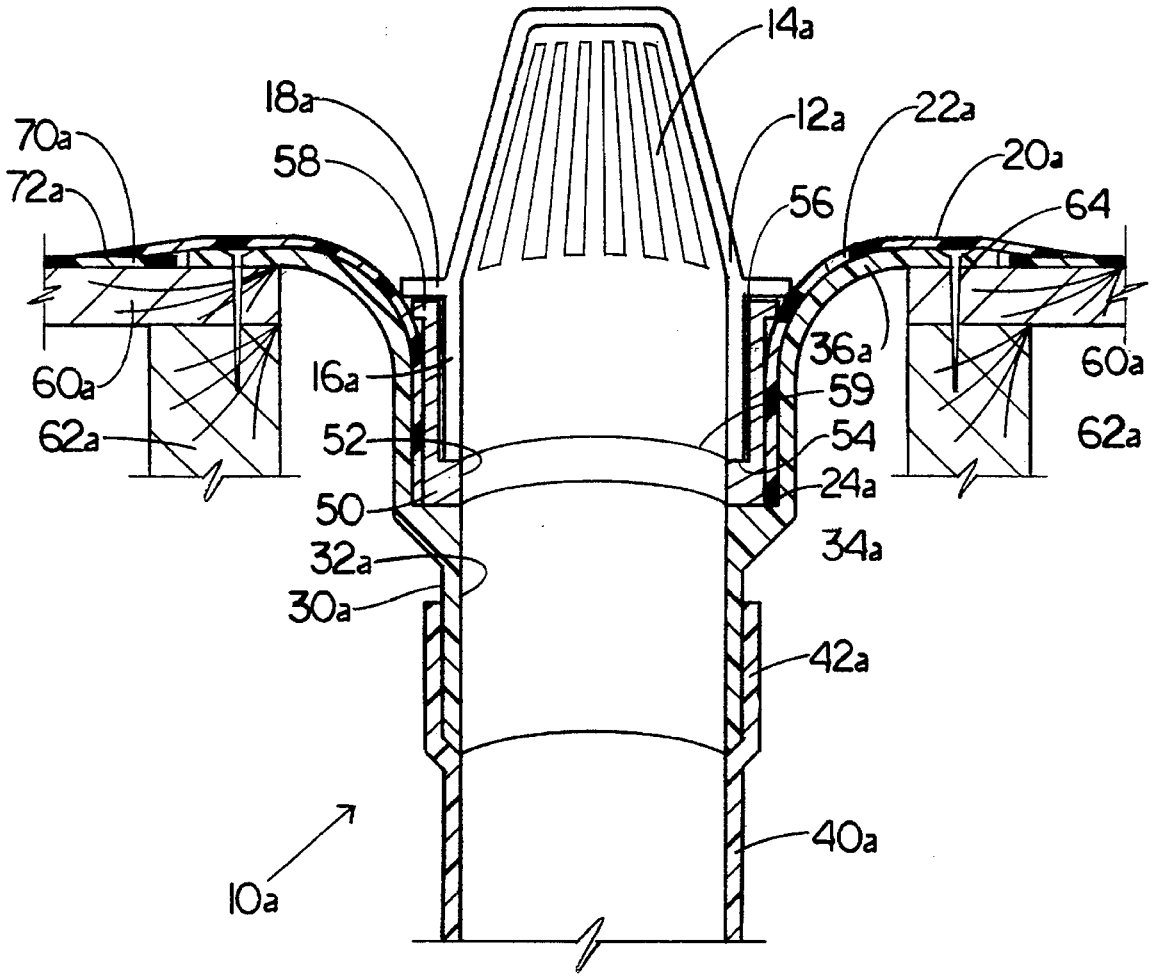
FIG. 4 is a longitudinal cross section through a drain modified for removal of the grate to enable cleaning the drain.

To facilitate cleaning the drain, a second embodiment **10*a* that includes a hub 50 is shown in FIG. 4. Like parts to those shown in FIGS. 1, 2, and 3, are similarly numbered with the addition of a suffix "a". The hub 50 has a longitudinal passageway 52 with a connection inlet 56 for receiving a removable grate collar 16*a* and a connection outlet 59 at the opposite end of the longitudinal passageway 52. Preferably, the longitudinal passageway 52 has at least one variation in the bore's diameter forming a stop 54**.

The hub 50 is preferably at least two inches in length with the connection inlet 56 comprising about one-fourth to one-third the total length of the longitudinal passageway 52. Preferably, the hub 50 also includes a ⅛ to 3/16 inch exterior hub flange 58. The hub 50 is made of PVC, ABS or similar materials approved for plumbing.

The contoured boot **20*a* is formed from a single piece of elastomer as described above in relation to FIGS. 1, 2, and 3. The boot 20*a* is contour shaped to snugly fit around the hub 50 at the connection outlet end of the hub and posterior to the exterior hub flange 58. The exterior hub flange 58 aids in maintaining the contours of boot 20*a*. To enable sealing to the synthetic membrane 70, the boot flange 22*a* extends a minimum of one inch beyond the outer most edge of the exterior hub flange 58 when the hub 50 is nested snugly into the flanged boot 20*a*. Positive contact between the boot flange 22*a* and external hub flange 58 minimizes the amount of water ponding between the boot 20 and the hub 50**.

To assemble the drain **10*a*, the contoured boot 20*a* is fitted over the hub 50. The nested hub 50 and boot 20*a* are press fitted into the longitudinal passage way 32*a* of the pipe connector 30*a* so that the hub 50 and boot outlet port 24*a* abut stop 34*a* as shown in FIG. 4. Alternatively, the nested hub 50 and boot 20*a* may be permanently sealed to the longitudinal passageway 32*a* via pressure fitting plus adhesives or sealants compatible with the elastomer used to form the boot 30*a*. Press fitting the nested hub 50 and boot 20*a* against the pipe connector stop 34*a* or permanently sealing the nested hub and boot to the longitudinal passageway 32 prevents any back flow of water between the exterior of the hub 50, boot 20*a* and longitudinal passageway 32*a***.

A grate collar **16*a* is removably inserted with light pressure into connecting inlet 56 and preferably abuts stop 54. Alternatively, the exterior grate flange 18*a* prevents the grate 10*a* from being inserted too far into the hub's longitudinal passageway 52. The completed drain is installed as described above for FIGS. 1, 2, and 3**.

In addition, external flange 36 at the anterior end of pipe connector 30 of FIGS. 1, 2, and 3 may be extended as shown by 36*a* of FIG. 4 to rest on the roof deck 60. The extended external flange 36*a* provides additional support for the weight of the drain 10*a* and, at the builder's or architect's option, may be secured to the roof deck 60*a* by screws, nails or other mechanical fasteners 64.

Figure 5:
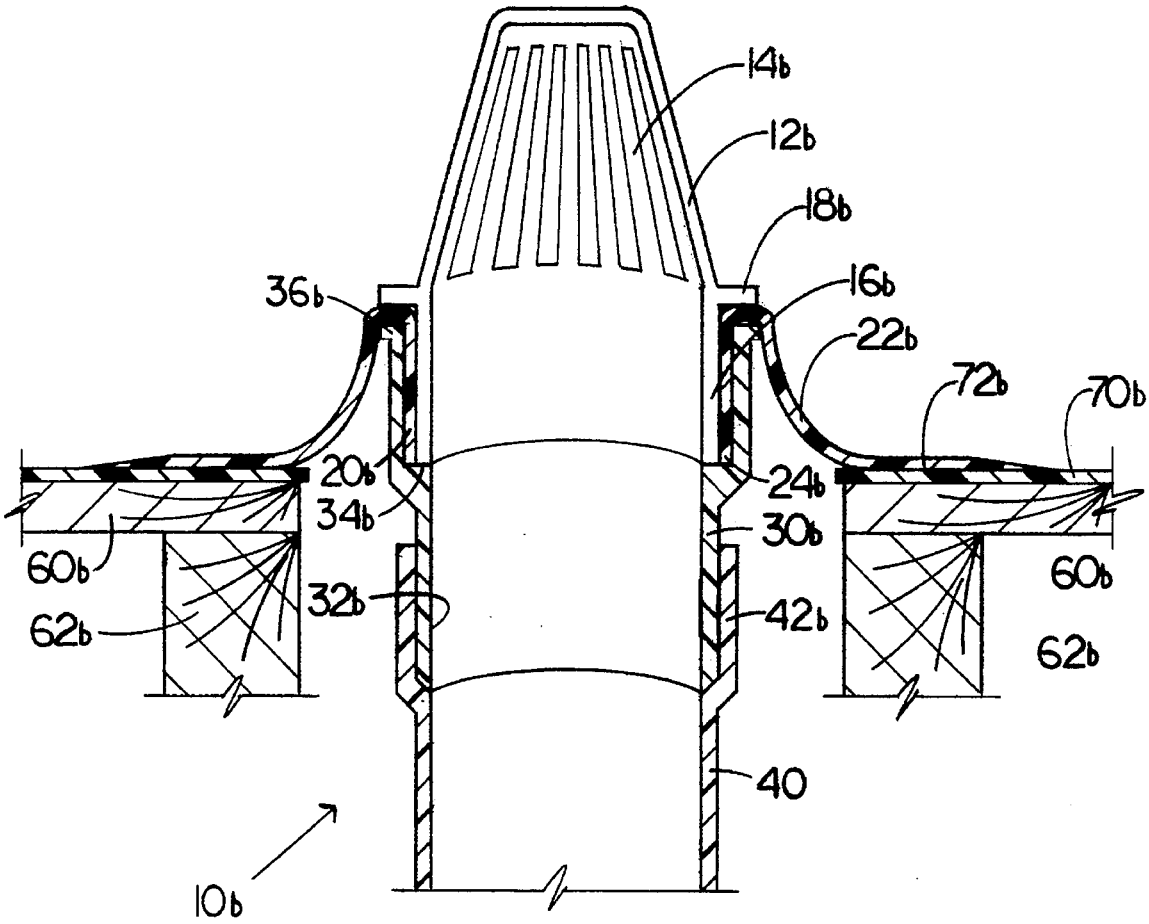
FIG. 5 is a longitudinal cross section through a drain modified for use as an emergency overflow structure.

A third embodiment 10*b* for use as an emergency overflow drain structure is shown in FIG. 5. Like parts to those shown in FIGS. 1, 2, and 3, are similarly numbered with the addition of a suffix "b". The parts differ between embodiment 10 and 10*b* in that the longitudinal dimensions of the grate 12*b* and/or pipe connector 30*b* are in creased as necessary to elevate the strainer above the synthetic membrane 70*b* and roof deck 60*b* to a desired height. The parts of drain 10*b* are prepared, assembled and installed as described for FIGS. 1, 2, and 3.

A variation of drain 10*b* (not shown) that utilizes the structures shown in FIG. 4 may be created by increasing the longitudinal dimensions of the grate 12*a* and/or hub 50 elevate the strainer above the synthetic membrane and roof deck. The parts of this variable of drain 10*b* are prepared, assembled and installed as describe for FIG. 4.

Figure 6:
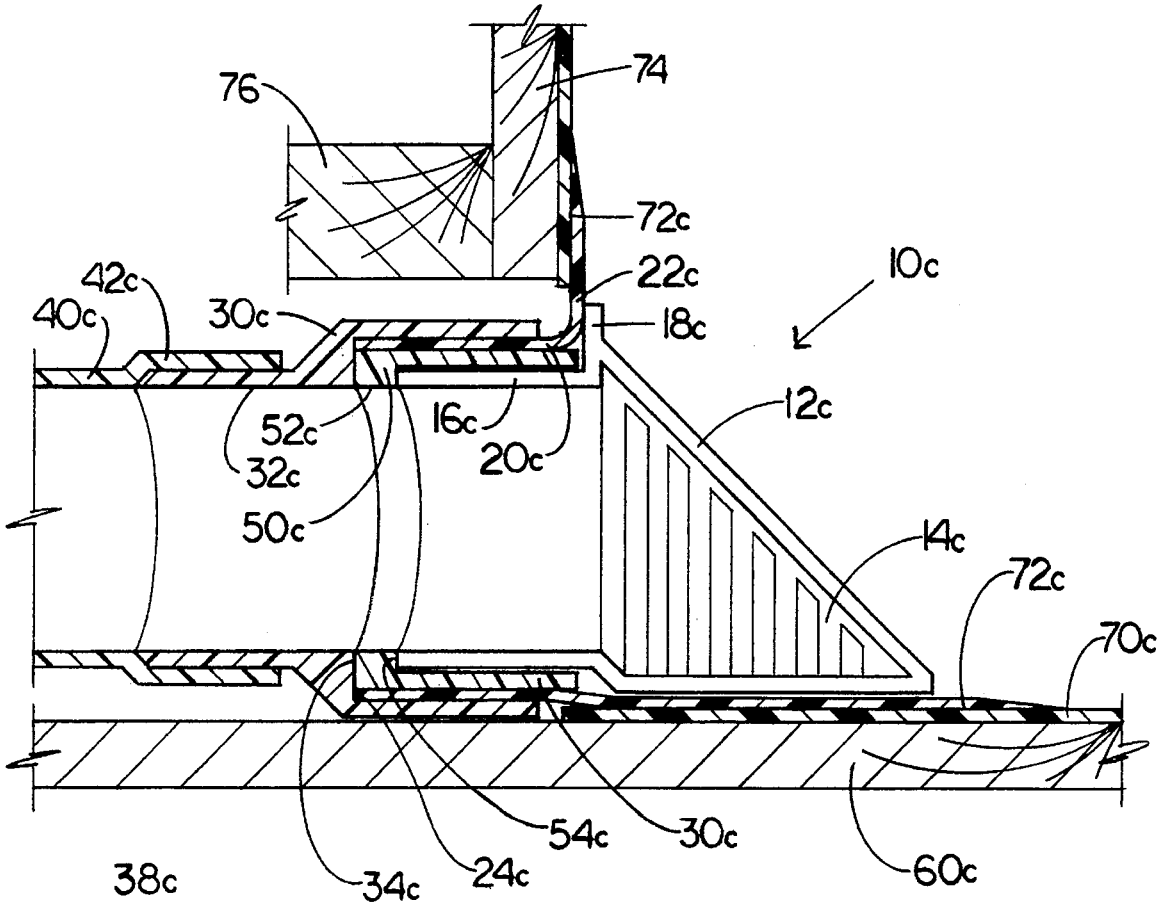
FIG. 6 is a longitudinal cross section through a drain connecting to a drain pipe housed in or entering the roof area through a wall where the wall and roof deck intersect.

A fourth embodiment 10*c* is shown in FIG. 6 and connects to a plumbing industry standard drain pipe 40*c* housed in or entering the roof area through a wall 74 where the wall 74 and roof deck 60 intersect. Like parts to those shown in FIGS. 1, 2, 3, and 4 are similarly numbered with the addition or substitution of the suffix "c".

As in the embodiments described above, the grate 12*c* includes a strainer 14*c* to prevent debris from entering the drain 10*c*. The strainer 12*c* may be flat (not shown) so that the outer most surface of the drain 10*c* is flush with the membrane 70*c* covering the wall 74. More preferably, to increase surface area of the strainer 14*a*, the strainer is dome-, frustrum-, rectangle-, or rectangular prism-shaped.

If the grate 12*c* is removable, the grate 12, boot 20*c*, hub 50*c*, and pipe connector 30*c* are prepared and assembled as described above for FIG. 4. If the grate is not removable, the boot, grate and pipe connector are prepared and assembled as describe above for FIGS. 1, 2, and 3. In all cases, the assembled drain 10*c* is inserted through an opening in the wall 74 and wall framing 76 at or near where the wall 74 and roof deck 60*c* intersect. The connector outlet port 38*c* is press-fitted into the receiving end 42*c* of the drain pipe 40*c*. To complete the installation, the perimeter of the boot flange 22*c* is overlapped onto to the single layer synthetic membrane 70*c* and a seal 72*c* formed between the boot flange 22*c* and the membrane 70*c* covering the wall 74 and roof deck 60*c*. The seal 72*c* may be formed by heat welding or other methods used for joining sheets of the synthetic membrane during installation of the single layer synthetic membrane 70*c*. The seal 72*c* must be formed along the entire perimeter of the boot flange 22*c*. The width of the seal 72*c* will be determined by the method of sealing but in no case less than one inch wide regardless of sealing method.

The novel features characteristic of this invention are set forth in the appended claims. While the invention is susceptible to various modifications and alternative constructions, certain illustrated embodiments thereof have been shown in the drawings and are described above. Various changes and modifications to the preferred embodiments described herein will be apparent to those skilled in the art; for example, using the drain for flat or low sloping structures such as balconies and decks instead of roofs, and fabricating multiple drain structures sharing a single boot. It should be understood, however, that there is no intention to limit the invention to the specific form disclosed, but on the contrary, the intention is to cover all modifications, alternative constructions and equivalents falling within the spirit and scope of the invention.

What is claimed is:

1. A drain assembly for use with a synthetic roofing or waterproofing membrane covering a flat or low sloping surface, comprising:

a grate having a strainer and a connecting collar;

a flanged tubular boot contoured to fit snugly around the grate's connecting collar comprising a tubular piece of an elastomer with an outlet port at one end and a flange around the circumference of the other end for sealably attaching the boot to the synthetic membrane, wherein the elastomer is identical to or compatible with and sealably attachable to the synthetic membrane and the elastomer and the synthetic membrane are made of materials selected from a group consisting of synthetic rubber, rubber-like materials, plastic, and plastic-like materials;

a pipe connector defining a longitudinal passageway and connecting the grate collar nested in the boot with the receiving end of a standard drain pipe.

2. The drain assembly of claim 1, wherein the pipe connector's longitudinal passageway has at least one variation in the longitudinal passageway's diameter forming a stop and when the grate collar is nested within the contoured boot the grate collar and boot are press fitted into the longitudinal passageway the grate's connecting collar and the boot's outlet port abut the pipe connector's stop.

3. The drain assembly of claim 1, wherein the grate collar is nested in the contoured boot and the grate collar and boot are press fitted into and permanently sealed to the pipe connector's longitudinal passageway with adhesives or sealants compatible with the pipe connector and the elastomer.

4. The drain assembly of claim 1, wherein the grate further includes an external grate flange adjacent to the intersection of the stainer and the grate collar.

5. The drain assembly of claim 4, wherein the grate strainer is rectangle, dome or frustrum-shaped.

6. The drain assembly of claim 5, wherein the boot flange extends a minimum of one inch beyond the outer most edge of the grate flange when the grate collar is nested snugly into the boot.

7. The drain assembly of claim 1, wherein the pipe connector includes an external flange at one end of the pipe connector's longitudinal passageway and a connection outlet at the other end of the pipe connector's longitudinal passageway.

8. The drain assembly of claim 7, wherein the pipe connector's external flange is adapted to rest on the flat or sloping surface providing support for the drain assembly.

9. A drain assembly for use with a synthetic roofing or waterproofing membrane covering a flat or low sloping surface, comprising:

a removable grate having a strainer and a connecting collar;

a hub having a longitudinal passageway, a connection inlet for receiving the removable grate at one end of the longitudinal passageway, and a connection outlet at the other end of the longitudinal passageway;

a flanged tubular boot contoured to fit snugly around the connection outlet end of the hub comprising a tubular piece of an elastomer with an outlet port at one end and a flange around the circumference at the other end for sealably attaching the boot to the synthetic membrane, wherein the elastomer is identical to or compatible with and sealably attachable to the synthetic membrane and the elastomer and the synthetic membrane are made of materials selected from a group consisting of synthetic rubber, rubber-like materials, plastic, and plastic-like materials; and a pipe connector defining a longitudinal passageway and connecting the hub nested in the contoured boot to a standard drain pipe.

10. The drain assembly of claim 9, wherein the pipe connector's longitudinal passageway has at least one variation in the longitudinal passageway's diameter forming a stop and when the hub is nested within the contoured boot and the hub and boot are press fitted into the pipe connector's longitudinal passageway the hub's connection outlet and the boot's outlet port abut the pipe connector's stop.

11. The drain assembly of claim 9, wherein the hub is nested in the contoured boot and the hub and boot are press fitted into and permanently sealed to the pipe connector's longitudinal passageway with adhesives or sealants compatible with the pipe connector and the elastomer.

12. The drain assembly of claim 9, wherein the hub's longitudinal passageway has at least one variation in diameter forming a stop and the grate collar abuts the hub's stop when the grate collar is removably inserted in the hub's connection inlet.

13. The drain assembly of claim 9, wherein the grate's strainer is rectangle, dome or frustrum-shaped.

14. The drain assembly of claim 12, wherein the grate further includes an external grate flange adjacent to the intersection of the stainer and the grate collar.

15. The drain assembly of claim 9, wherein the hub further includes an external hub flange.

16. The drain assembly of claim 15, wherein the boot flange extends a minimum of one inch beyond the outer most edge of the external hub flange when the hub is nested snugly into the boot.

17. The drain assembly of claim 9, wherein pipe connector includes an external flange at one end of the pipe connector's longitudinal passageway and a connection outlet at the other end of the pipe connector's longitudinal passageway.

18. The drain assembly of claim 17, wherein the pipe connector's external flange is adapted to rest on the flat or sloping surface providing support for the drain assembly.

* * * * *